US006041518A

United States Patent [19]

Polycarpe

[11] Patent Number: 6,041,518

[45] Date of Patent: Mar. 28, 2000

[54] CLIMATE CONTROLLED SHOE

[76] Inventor: Phito Polycarpe, 22 Orchard Pl., Valley Stream, N.Y. 11580

[21] Appl. No.: 09/270,771

[22] Filed: Mar. 17, 1999

[51] Int. Cl.[7] ..... A43B 7/04; A43B 7/08

[52] U.S. Cl. ..... 36/2.6; 36/3 R; 36/3 A; 36/3 B

[58] Field of Search ..... 36/2.6, 3 R, 3 A, 36/3 B

[56] References Cited

U.S. PATENT DOCUMENTS

| | | | |
|---|---|---|---|
| 2,701,923 | 2/1955 | Toman . | |
| 3,048,931 | 8/1962 | Farinello . | |
| 3,273,264 | 9/1966 | Farinello, Jr. . | |
| 5,086,572 | 2/1992 | Lee . | |
| 5,220,791 | 6/1993 | Bulzomi . | |
| 5,367,788 | 11/1994 | Chen | 36/3 B |
| 5,722,185 | 3/1998 | Vigneron | 36/2.6 |
| 5,813,140 | 9/1998 | Obeid | 36/3 R |
| 5,815,949 | 10/1998 | Sessa | 36/3 B |
| 5,918,381 | 7/1999 | Landry . | |

*Primary Examiner*—Ted Kavanaugh
*Attorney, Agent, or Firm*—Darby & Darby

[57] ABSTRACT

A battery powered climate-controlled shoe which controls the climate surrounding a user's foot in the shoe during a wide range of weather conditions. The shoe contains a plurality of switches, one of which is an interlock for inhibiting operating of the system until a pressure sensitive switch is activated by the insertion of a foot into the shoe. The shoe also contains a fan and a metallic heating plate. The fan aids in the circulation of air within the shoe, and the heating plate provides warm air for circulation within the shoe during cold weather.

15 Claims, 4 Drawing Sheets

CLIMATE CONTROLLED SHOE

BACKGROUND OF THE INVENTION

The present invention relates to a shoe, and more particularly to a battery powered climate-controlled shoe which controls the climate surrounding a user's foot in the shoe during a wide range of weather conditions.

During outdoor activities performed during the summer months such as walking, mountain climbing, hiking, construction, and the like (where the outside temperature may rise to more than 110° degrees), the temperature inside a person's shoe can easily reach 140°, and hence the feet will sweat. Once the feet begin to sweat, athlete's foot blisters and odors can occur soon thereafter.

On the other hand, during winter activities, feet within shoes tend to get very cold. Naturally, a solution is to warm the feet to prevent frostbite and other such maladies. One way to do this is to use a heating pad or other heating devices. However, as a result of the high degree of humidity produced by such devices inserted inside the shoe, the feet may begin to sweat and athlete's foot, blisters and foul odors can occur.

Another general solution to the problem of sweaty feet is through the use of socks. However, once the socks are saturated with sweat the feet are again subjected to a humid environment which permits the development of athlete's foot, blisters, and the like.

Artisans have also attempted to solve this problem by creating shoes with openings so that air can flow into the shoe. Other remedies have also included placing a heating pad inside the shoe, or using a heating system which increases the humidity level within the shoe.

U.S. Pat. No. 5,722,185 is directed to a heated shoe having a heel, a sole provided with a heating device and an outside face for making contact with the ground, and at least one energy-providing battery located in the heel and connected to the heating device. In this patent, the heating device comprises a heating film or cloth extending over at least a portion of the sole parallel to its outside face. The sole also includes a structure of closed cells extending between the heating film or cloth and the outside face of the sole.

U.S. Pat. No. 5,367,788 discloses a shoe which includes a shoe sole having an accommodating portion and several ventilation holes formed through the side wall of the accommodating portion. A pressure-operated electric generator is provided in the accommodating portion and produces a voltage signal when pressure is repeatedly applied on the shoe sole during use. A cooling apparatus is provided inside the accommodating portion and produces cold air when the electric generator supplies the voltage signal to the cooling apparatus so as to cool the feet of a user.

SUMMARY OF THE INVENTION

It is an object of the present invention to provide a climate-controlled shoe which alleviates sweaty feet, Athlete's foot, blistered feet, etc., due to high temperatures and humidity during cold or hot weather at reduced costs.

This and other objects and advantages are achieved by the climate controlled shoe according to the invention by providing a fan, a heater and a constant air intake via an air channel which runs from the fan to the top of the shoe. During activities performed in the presence of high temperatures inside or outside of the shoe (for example, 110° to 140° and greater), a simple activation of the fan is all that is needed to cool the feet of a user. Fresh air constantly enters the shoe through air vents located at the top of the shoe. As a result, air circulates around the entire shoe and thus keeps the feet of a user dry.

During activities perform in cold weather, the heater and the fan are activated (not the heater alone in order to prevent humidity), warm air circulates around the shoe thus keeping the feet warm and dry. To prevent high levels of humidity within the shoe, it is not possible to the heater alone. Utilizing this system according to the invention, construction workers (for example) are no longer required to take numerous breaks in order to gain relief from the bitter cold because they can simply activate the heater when their feet get cold.

It is another object of the present invention to eliminate the use of powder in order to prevent athlete's foot.

It is a further object of the present invention to eliminate the use of socks while wearing shoes in order to prevent feet from sweating.

It is still another object of the invention to eliminate the need to wear a heating pad in a shoe, or a shoe which has a humidity heating device.

Yet another object of the present invention is to eliminate the use of foot medications in order to prevent athlete's foot.

Another object of the invention is to provide climate-control in a wide range of footwear, for example, construction boots, hiking boots, climbing boots, arctic shoes, ski boots, and the like.

Other objects, advantages and novel features of the present invention will become apparent from the following detailed description of the invention when considered in conjunction with the accompanying drawings.

BASIC DESCRIPTION OF THE DRAWINGS

Figure 3A:
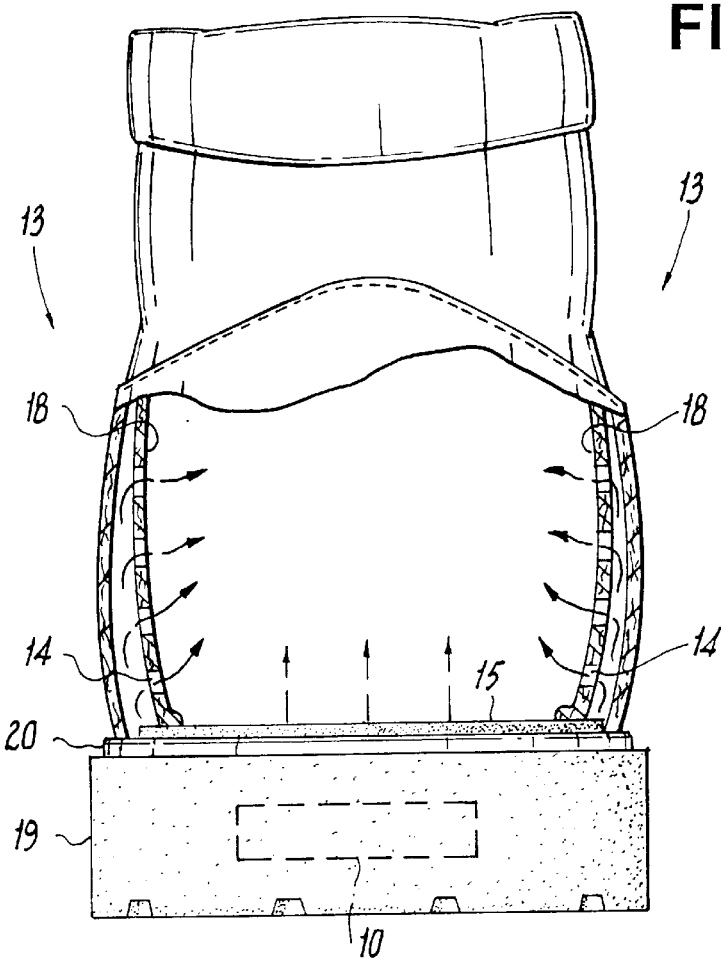
Figure 3B:
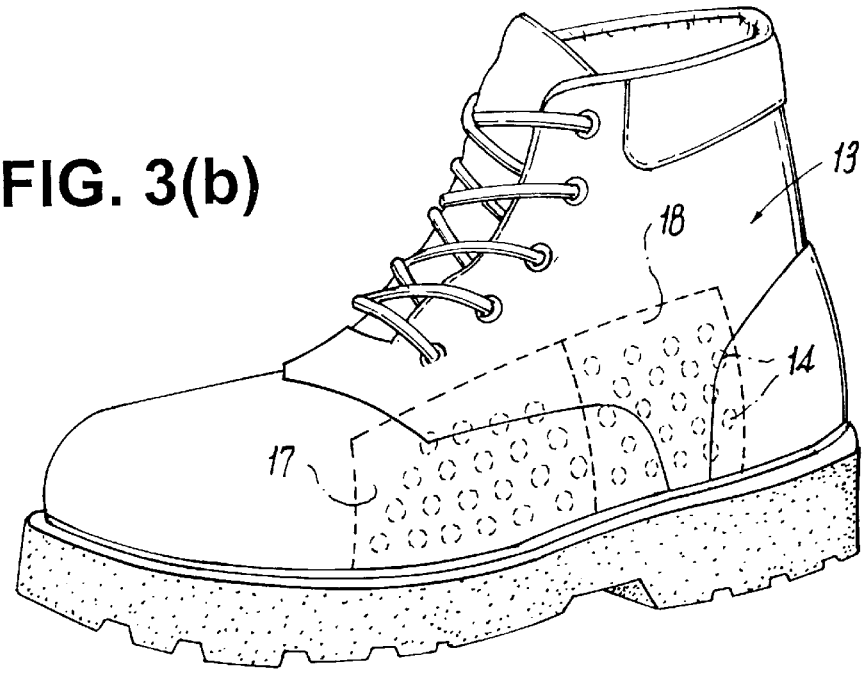
Figure 4:
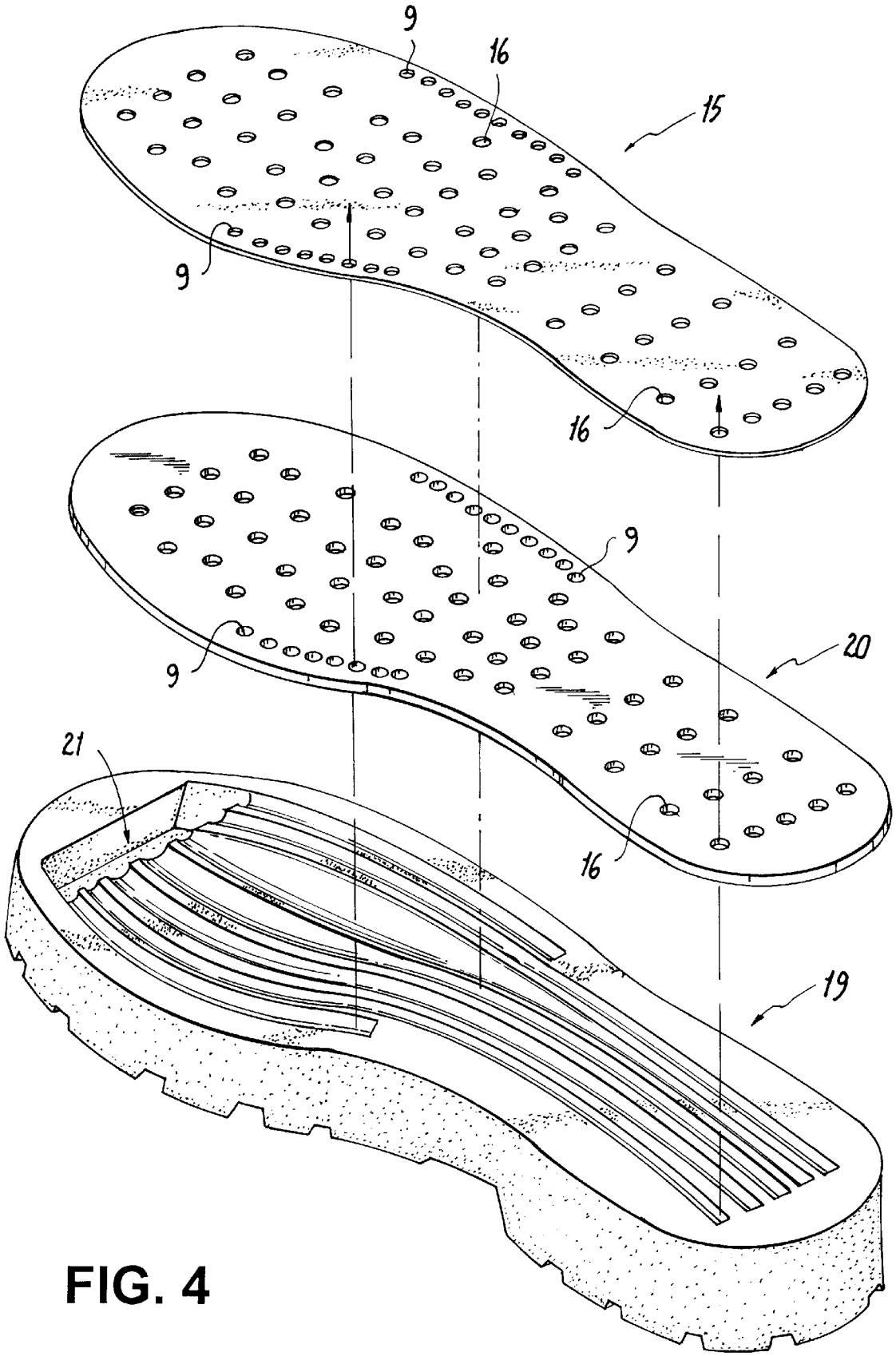
Figure 5:
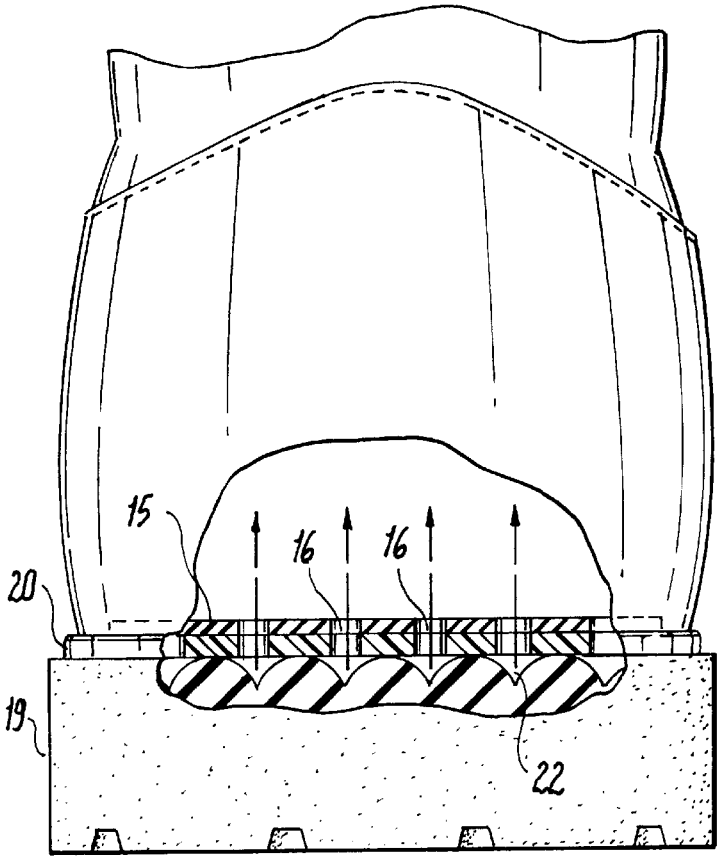
Figure 6:
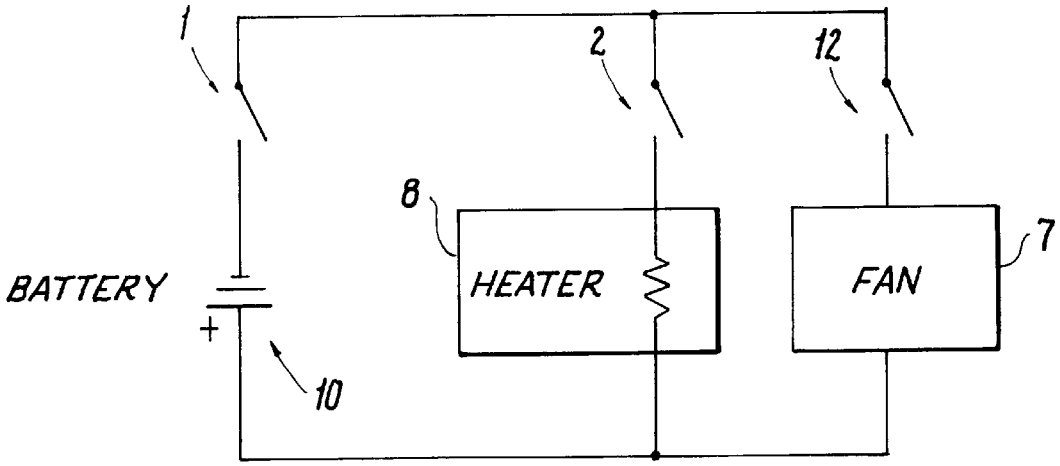

FIGS. 3(*a*) and 3(*b*) show the panels in the sides of the shoe according to the invention; and FIG. 4 shows the construction of the sole of the shoe according to the invention;

FIG. 5 is a rear cross-section of the showing the sole of the shoe according to the invention; and FIG. 6 is a schematic diagram of the circuit used to implement the climate control system of the shoe according to the invention.

DETAILED DESCRIPTION OF DRAWINGS

Figure 1:
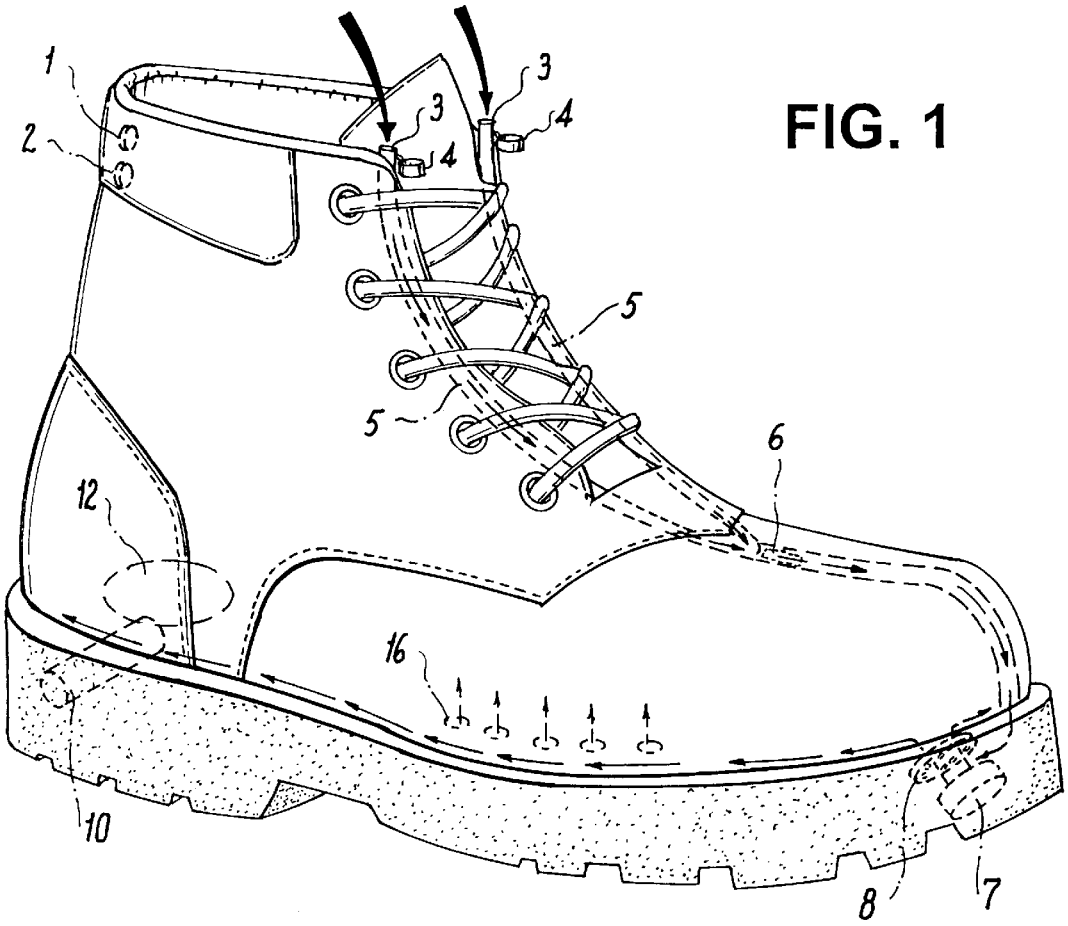
FIG. 1 is a side view of the shoe according to the invention.

As shown in FIG. 1, the climate-controlled shoe is equipped with three switches. The primary switch 1 and the heater switch 2 are located inside the shoe (in a rear area of the shoe, for example), the third switch, which is the fan secondary switch 12, is situated in the sole of the shoe (i.e., the heal area). If the primary switch is activated, the fan secondary switch 12 is also activated upon insertion of a foot inside the shoe (i.e., a flexible sole insert 15 facilitates actuation of the fan secondary switch 12 which is pressure sensitive).

Figure 2:
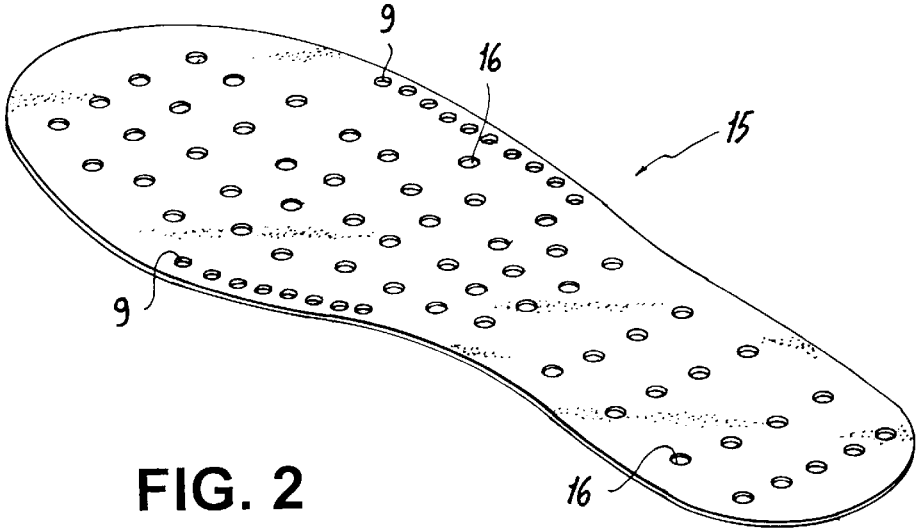
FIG. 2 is a top view of the flexible pad insert of the shoe according to the invention.

When the primary switch 1 is activated and pressure is applied to the area of the fan secondary switch 12, the fan 7 may be activated. Fresh air enters the shoe through the entrance 3 of the air intake channel 5 (i.e., a flexible hollow plastic tube running past the lace hole area, from the fan 7 to the top of the shoe, for example). A tiny plug like cover 4 is disposed near each air entrance 3. An optional air filter 6 (cloth like material) is also situated inside the air intake channel 5, at the base of the "v" formed by the intersection of the two sides of the shoe. Naturally, one skilled in the art would recognize that the shape of the intersection could take different forms (for example, a square or "u"). Air circulates throughout the entire shoe through air cavities 9 via holes 16 in the flexible sole insert 15 and sides of the shoe, as shown in FIG. 2.

As shown in FIGS. 3(*a*) and 3(*b*), the shoe's side 13 contains a first panel 17 and a second panel 18; the panels are mounted onto the sole and flexible insert 15 of the shoe, and are in fluid communication with a line of air cavities 9 disposed between the two panels. The opposite side of the shoe also contains an identical pair of panels arranged in this manner (not shown). Air enters the panels and exits toward the foot through side air cavities 14 which are located on the inside of the shoe. As a result, the feet of a user remain fresh and dry due to the air flow within the shoe.

A resistive heating element 8 (a perforated metallic plate, for example), activated by heater switch 2, is arranged in the output air flow path of the fan 7. When the heating element 8 (a perforated metallic plate, for example) and the fan 7 are activated simultaneously, warm air travels throughout the shoe via the side air cavities 14, and thus the feet of a user remain warm and dry.

The system is powered by a battery 10 located in the sole of the shoe (i.e., in the heal area). The plugs 4 can be used at the user's discretion, for example, if an area is excessively dusty or to prevent water from entering the shoe.

As shown in FIG. 4, the sole of the shoe is typically comprised of three parts: a bottom pad 19, a rigid pad 20 and the flexible pad 15. The bottom pad 19 of the sole supports the weight of the user. As shown in FIG. 5, its upper surface contains horizontal "M" shape loops (for example) which form grooves which allow air to circulate from the bottom pad 19 through the air holes 16 of the rigid pad 20 and the flexible pad 15. In addition, air from the fan 7 enters the sole through an opening 21 in the bottom pad 19 which is in fluid communication with the grooves 22.

The rigid pad 20 (a hard light-weight plastic, for example) serves to protect or prevent the obstruction of air through the grooves 21. The flexible pad 15 is a firm, comfortable pad like insert. This pad should be firm in order to prevent misalignments of its air holes 16 with the air holes 16 of the rigid pad 20.

FIG. 6 shows an example of circuitry which permits operation of the shoe by the user in accordance with the objects of the invention. The electrical wiring is embedded in the sole of the shoe in a manner which is readily apparent to one skilled in the art, and is therefore not illustrated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A climate controlled shoe, comprising:

a primary switch arranged in a rear area of the shoe;

a battery arranged in a heel of the shoe and coupled in series to the primary switch;

a heating element arranged in a sole of the shoe;

a secondary switch coupled in series to the heating element;

a fan arranged in a toe area of the shoe and beneath the heating element for circulating outside air throughout the shoe;

a fan secondary switch, arranged in a rear area of the shoe, coupled in series to the fan and connected in parallel to the primary switch and the secondary switch, respectively;

air intake channels arranged along a front edge of the shoe;

a first panel disposed in a right side of the shoe;

a second panel disposed in a left side of the shoe; and a sole insert having air cavities in fluid communication with the first panel, the second panel and the air intake channels;

wherein when the primary switch and the fan secondary switch are closed, the outside air enters the shoe via the air intake channels and the fan distributes air throughout the shoe to cool a foot of a user.

2. The shoe according to claim 1, further comprising:

covers disposed in an entrance of the air intake channels.

3. The shoe according to claim 2, wherein the fan secondary switch is a pressure sensitive switch.

4. The shoe according to claim 2, wherein the filter comprises webbed cloth.

5. The shoe according to claim 1, further comprising:

a filter arranged in the air intake channels.

6. The shoe according to claim 1, wherein upon activation of the fan secondary switch warm air flows around the shoe, when the primary switch is closed and the fan is activated.

7. The shoe according to claim 1, wherein the fan secondary switch is a pressure sensitive switch.

8. The shoe according to claim 1, wherein the filter comprises webbed cloth.

9. The shoe according to claim 1, wherein the heating element is a resistive element.

10. The shoe according to claim 1, wherein the heating element is a perforated metallic plate.

11. The shoe according to claim 1, wherein the shoe is one of a climbing boot, a hiking boot, a construction boot and a ski boot.

12. A climate controlled shoe, comprising:

a primary switch arranged in a rear area of the shoe;

a battery arranged in a heel of the shoe and coupled in series to the primary switch;

a first panel disposed in a right side of the shoe;

a second panel disposed in a left side of the shoe;

air intake channels arranged along a front edge of the shoe;

a sole having grooves in fluid communication with the first panel, the second panel and the air intake channels;

a heating element arranged in the sole of the shoe;

a secondary switch coupled in series to the heating element;

a fan arranged in a toe area of the shoe and beneath the heating element for circulating outside air throughout the shoe; and a fan secondary switch, arranged in a rear area of the shoe, coupled in series to the fan and connected in parallel to the primary switch and the secondary switch, respectively;

wherein when the primary switch and the fan secondary switch are closed, the outside air enters the shoe via the air intake channels and the fan distributes air throughout the shoe to cool a foot of a user.

13. The shoe according to claim 12, wherein the sole comprises:

a flexible pad having first air holes;

a rigid pad having second air holes in fluid communication with the first air holes; and a bottom pad having an opening in a toe area.

14. The shoe according to claim 13, wherein said grooves extend longitudinally along a top surface of the sole and allow air from the fan to flow into the shoe via the first panel, the second panel and the air intake channels.

15. A climate controlled shoe, comprising:

a primary switch;

a battery arranged in a heel of the shoe coupled in series to the primary switch;

a heating element arranged in a sole of the shoe;

a secondary switch coupled in series to the heating element;

air intake channels for introducing outside air into the shoe;

a fan arranged beneath the heating element for circulating the air throughout the shoe;

a fan secondary switch coupled in series to the fan and connected in parallel to the primary switch and the secondary switch, respectively;

at least one panel on a left and right side of the shoe, respectively; and a sole insert having air cavities in fluid communication with the at least one panel and the air intake channels;

wherein when the primary switch and the fan secondary switch are closed, outside air enters the shoe via the air intake channels and the fan distributes air throughout the shoe such that a user's foot is cooled.

* * * * *